US010681459B1

(12) United States Patent
Breitenmoser et al.

(10) Patent No.: US 10,681,459 B1
(45) Date of Patent: Jun. 9, 2020

(54) HEARING DEVICES WITH ACTIVITY SCHEDULING FOR AN ARTIFACT-FREE USER EXPERIENCE

(71) Applicant: Sonova AG, Staefa (CH)

(72) Inventors: Andreas Breitenmoser, Zurich (CH); David Perels, Zurich (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/259,686

(22) Filed: Jan. 28, 2019

(51) Int. Cl.

| | |
|---|---|
| ***H04R 3/00*** | (2006.01) |
| ***H04R 25/00*** | (2006.01) |
| ***H04R 3/04*** | (2006.01) |
| ***H04R 29/00*** | (2006.01) |
| ***G10L 21/0232*** | (2013.01) |

(52) U.S. Cl.
CPC ..... *H04R 3/04* (2013.01); *G10L 21/0232* (2013.01); *H04R 25/30* (2013.01); *H04R 29/001* (2013.01); *H04R 2460/01* (2013.01)

(58) Field of Classification Search
CPC . H04R 3/00; H04R 3/04; H04R 25/00; H04R 25/30; H04R 25/45; H04R 25/48; H04R 25/50; H04R 29/00; H04R 29/001; H04R 2460/01; G10L 21/0232
See application file for complete search history.

(56) References Cited

U.S. PATENT DOCUMENTS

| | | | | |
|---|---|---|---|---|
| 4,989,251 | A | 1/1991 | Mangold | |
| 7,181,033 | B2 | 2/2007 | Fischer et al. | |
| 7,340,073 | B2 | 3/2008 | Fischer | |
| 7,653,205 | B2 | 1/2010 | Allegro Baumann et al. | |
| 8,682,011 | B2 | 3/2014 | Komagel et al. | |
| 2003/0091197 | A1 | 5/2003 | Roeck et al. | |
| 2006/0233407 | A1* | 10/2006 | Steinbuss | H04R 25/502 381/317 |
| 2008/0112583 | A1* | 5/2008 | Kornagel | H04R 25/70 381/314 |
| 2008/0285781 | A1 | 11/2008 | Aerts et al. | |
| 2012/0200172 | A1* | 8/2012 | Johnson | H04R 29/001 307/116 |

(Continued)

FOREIGN PATENT DOCUMENTS

| | | | |
|---|---|---|---|
| WO | 2015/192870 | A1 | 12/2015 |
| WO | 2017/211426 | A1 | 12/2017 |

*Primary Examiner* — Thang V Tran

(57) ABSTRACT

Systems and methods for hearing devices with artifact mitigation. Some embodiments schedule, reschedule, or trigger, activities of a hearing device at points in time in order to achieve an artifact-free (or artifact-reduced) user experience. For example, some embodiments provide a method for scheduling reconfigurations of a hearing device to reduce an impact of resulting artifacts on a user experience. The method can include detecting a reconfiguration of operating characteristics (e.g., hardware or software) of a hearing device that will produce an artifact. Then, a masking event can be identified that can disguise the artifact produced by the reconfiguration of the operating characteristics. For example, the masking event can be an audio event from an audio signal received from a source external to the hearing device or a system notification generated by the hearing device. The reconfiguration can be scheduled or triggered so that the artifact is produced during the masking event.

26 Claims, 8 Drawing Sheets

(56) References Cited

U.S. PATENT DOCUMENTS

| | | | | |
|---|---|---|---|---|
| 2013/0108096 | A1* | 5/2013 | Fitz | H04R 25/43 381/320 |
| 2015/0092967 | A1* | 4/2015 | Fitz | H04R 25/453 381/317 |
| 2016/0366527 | A1* | 12/2016 | Jones | H04R 25/75 |
| 2017/0127201 | A1 | 5/2017 | Roeck et al. | |

* cited by examiner

HEARING DEVICES WITH ACTIVITY SCHEDULING FOR AN ARTIFACT-FREE USER EXPERIENCE

TECHNICAL FIELD

Various embodiments of the present technology generally relate to artifact mitigation in hearing devices. More specifically, some embodiments of the present technology relate to hearing devices with dynamic scheduling of system state changes to reduce or eliminate artifacts from the user experience.

BACKGROUND

Hearing devices are generally small complex devices used to improve the hearing capability of individuals. Hearing devices can be used to compensate for hearing impairments or to provide a sound source (e.g., headphones, earbuds, etc.). Some common examples of hearing devices used to compensate for hearing impairments include, but are not limited to, Behind-The-Ear (BTE) devices, Receiver-In-the-Canal (RIC) devices, In-The-Ear (ITE) devices, Completely-In-Canal (CIC) devices, and Invisible-In-The-Canal (IIC) devices. A user can select from these, or other, hearing devices based on a variety of preferences and hearing impairment needs. For example, one type of hearing device may be a preferred by an individual over another when factors such as hearing loss, aesthetic preferences, lifestyle needs, budget, and the like are considered.

With advances in technology such as improved processing and communication protocols, hearing devices have more functionality and increased performance than ever before. For example, this additional functionality can include additional signal processing techniques, Bluetooth® audio streaming from external sources such as phones or televisions, and the like. These additional features and performance mitigate the impact of the hearing impairment and allow the user of the hearing device to better interact with the environment and manage the hearing loss. Unfortunately, the addition of functionality and performance increases the number of potential operating states of the hearing device. As such, the hearing device may be switching between these states more often to optimize the experience for the user.

In some cases, the switching between the operating states of the hearing devices can inject undesirable sounds (called artifacts) into the user experience. The undesirable sounds are not the result of external environment, but are a product of the software and/or hardware switching configurations. For example, these undesirable sounds may be perceived by the user as a popping, sizzling, increase in volume level, or other spurious sound event. The user is often left frustrated as these spurious sound events can, from the user's perspective, seem to be happening randomly in many cases. As such, techniques are needed for minimizing the perception of these spurious sound events by the user.

SUMMARY

Systems and methods are described for artifact mitigation within of hearing devices. Some embodiments schedule, reschedule, or trigger, activities of a hearing device at the optimal points in time in order to achieve an artifact-free (or reduced) user experience. For example, some embodiments provide a method for scheduling reconfigurations of a hearing device to reduce an impact of resulting artifacts on a user experience. The method can include detecting a reconfiguration of operating characteristics (e.g., hardware or software) of a hearing device that will produce an artifact. The detected reconfiguration may be occurring at that moment or in the future (e.g., scheduled, queued for execution, etc.). Then, a masking event can be identified that can disguise the artifact produced by the reconfiguration of the operating characteristics. For example, the masking event can be an audio event from an audio signal received from a source external to the hearing device (e.g., streamed audio such as, but not limited to, Bluetooth Classic Advanced Audio Distribution Profile (A2DP) audio streams, etc.) or a system notification generated by the hearing device. In some embodiments, the reconfiguration of the operating characteristics can be scheduled or triggered so that the artifact is produced during the masking event. In some embodiments, a masking event may be artificially generated for the purpose of hiding the artifact.

In some embodiments, a buffer of an audio signal received by a microphone of the hearing device can be analyzed to detect audio characteristics of the audio signal that will hide the artifact. A profile of the artifact that will be produced by the reconfiguration of the operating characteristics can be generated. The profile of the artifact, in some embodiments, can represent a set of defining features (e.g., length, peak volume, frequency distribution, etc.) along with other characteristics (e.g., disruption level, etc.). In other embodiments, the profile of the artifact can represent a specific class of artifacts.

This profile can be used, in some embodiments, to help identify the masking event which is based, at least in part, on analyzing a buffer of an audio signal received by a microphone of the hearing device to detect audio characteristics of the audio signal that will hide the artifact. In some embodiments, the profile of the artifact can include a frequency analysis identifying one or frequency components (e.g., from an fast Fourier Transform) and identifying the masking event can include performing a frequency analysis of the audio signal to identify the masking event that minimizes differences between the profile of the artifact and a corresponding portion of the audio signal. In some embodiments a prediction that future masking events will occur within a time frame may also be generated. This can be done, for example, using machine learning, statistical analysis, historical patterns, and/or other data or specific techniques. During the time frame, scheduling of the reconfiguration of state changes related to the operating characteristics of the hearing device can be delayed until a masking event is detected.

Some embodiments provide for a method for mitigating artifacts produced by a hearing device. In some embodiments, the activity of a hearing device can be monitored to detect an initial scheduling of a reconfiguration of one or more operating characteristics of the hearing device. A determination can be made as to whether the reconfiguration of the one or more operating characteristics will result in an artifact that will be detectable by a user. A masking event can be identified for any artifact that will be detectable by the user. While multiple masking events may be available for selection, some embodiment select a masking event that can disguise the artifact produced by the reconfiguration of the one or more operating characteristics. The reconfiguration of operating characteristics of the hearing device can then be reschedule (e.g., taking into account any delay) so that the artifact is produced during the masking event.

Embodiments of the present invention also include computer-readable storage media containing sets of instructions to cause one or more processors to perform the methods, variations of the methods, and other operations described herein.

Some embodiments include a hearing device with an artifact mitigation system to improve a user experience of the hearing device. The hearing device can include a processor, a battery, a microphone, a digital signal processor, an artifact manager, a buffer, a speaker, a controller, and/or other components. These components of the hearing device may be implemented as hardware components and/or software components. For example, the artifact manager may be realized, in some embodiments, as software (e.g., running on the controller) or in hardware (e.g., a dedicated hardware component.

The controller can be configured to receive requests requesting to schedule a reconfiguration of operating characteristics of the hearing device. These requests can originate from other components within the hearing device, the user, or from an external source. The artifact manager can be communicably coupled to the controller and configured to determine a current state of the hearing device and whether the reconfiguration of the operating characteristics will result in an artifact. In some embodiments, the artifact manager can identify, upon a determination being made that the reconfiguration will result in an artifact, a masking event that can disguise the artifact produced by the reconfiguration of the operating characteristics. The artifact manager may also schedule, reschedule, or trigger the reconfiguration of operating characteristics of the hearing device so that the artifact is produced during the masking event by responding to the requests.

The buffer can be configured to store an audio signal received by the microphone. In some embodiments, the artifact manager can be configured to identify the masking event by analyzing the audio signal stored in the buffer to detect audio characteristics during a portion of the audio signal that will attenuate an impact of the artifact on the user experience. The artifact manager may identify an optimal masking event by using an optimization solver to evaluate an audio signal subject to one or more constraints (e.g., frequency content, volume level minimums, timing windows, etc.).

In some embodiments, a control layer can be used to link a module that generates the artifact (e.g., wireless module) and instead of having this module acting independently, the control layer provides a feedback connection that consults supervisory module to identify a time given the sound classification or to wait for a selected period of time (e.g., 500 ms, 2 s, etc.) before acting on the change. The control layer and supervisory module, in various embodiments, may be part of the artifact manager or implemented in other components.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the scope of the present invention. Accordingly, the drawings and detailed description are to be regarded as illustrative in nature and not restrictive.

BRIEF DESCRIPTION OF THE DRAWINGS

Embodiments of the present technology will be described and explained through the use of the accompanying drawings.

Figure 1:
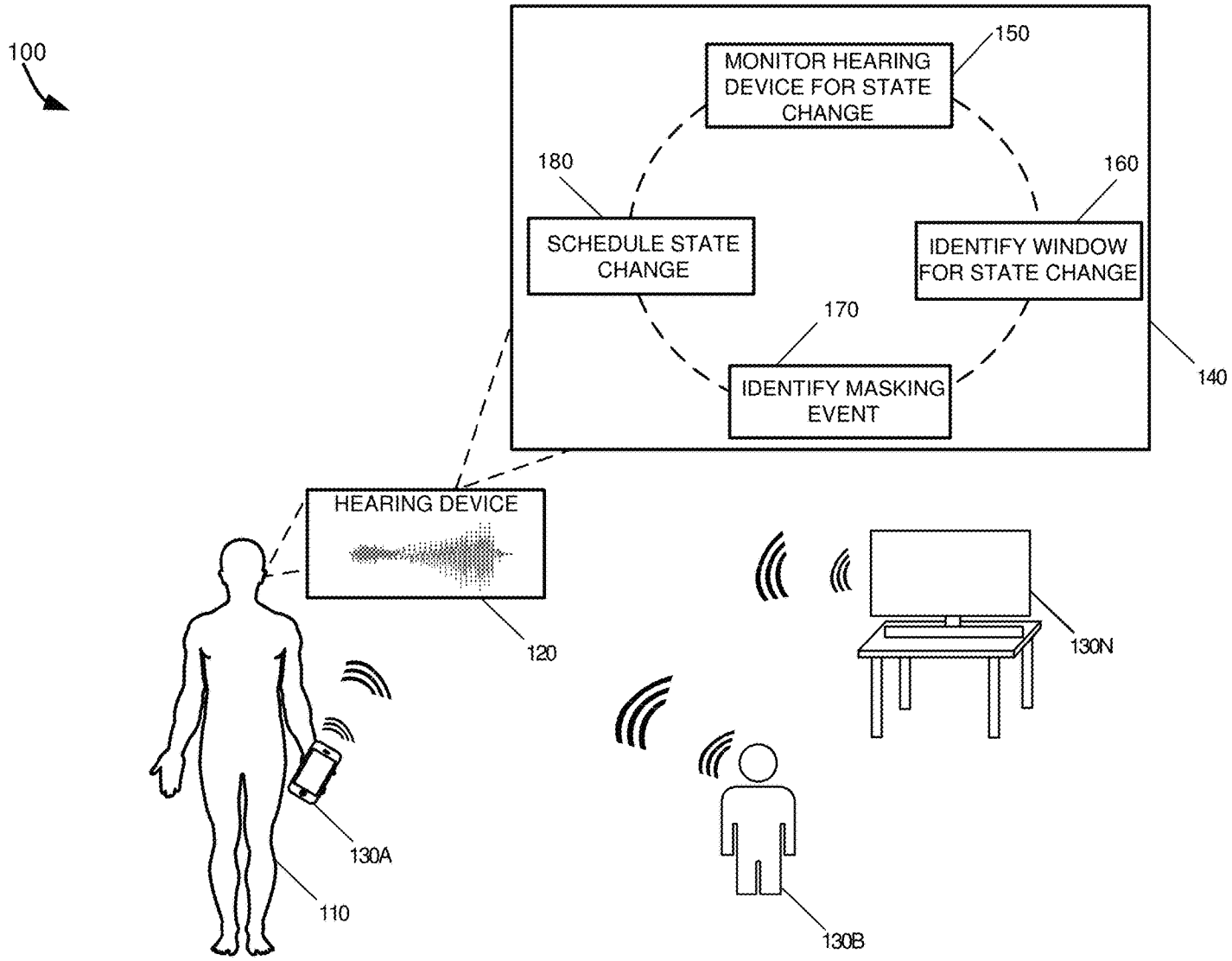
FIG. 1 illustrates an example of an environment in which some embodiments of the present technology may be utilized.

The drawings have not necessarily been drawn to scale. Similarly, some components and/or operations may be separated into different blocks or combined into a single block for the purposes of discussion of some of the embodiments of the present technology. Moreover, while the technology is amenable to various modifications and alternative forms, specific embodiments have been shown by way of example in the drawings and are described in detail below. The intention, however, is not to limit the technology to the particular embodiments described. On the contrary, the technology is intended to cover all modifications, equivalents, and alternatives falling within the scope of the technology as defined by the appended claims.

DETAILED DESCRIPTION

Various embodiments of the present technology generally relate to artifact mitigation in hearing devices. More specifically, some embodiments of the present technology relate to hearing devices with dynamic scheduling to reduce or eliminate artifacts from the user experience. When hearing devices are running, undesired but sensible, particularly audible, artifacts can occur due to changes in the hearing devices' activities or underlying configurations. The artifacts can be perceived by the user as crackling noises, popping noises, static noises, whistling, howling, ringing, temporary and sudden changes in volume, humming, buzzing, or other spurious sound events that are not a product of the environment but instead are creations of the hardware and software of the hearing devices changing configurations or states.

For example, changes may be caused by reconfigurations of use cases or coexistence situations. The use cases or coexistence configuration can include parallel activities that are added to or removed from already existing activities (e.g., Telecoil coexistence with 2.4 GHz). These changes can produce artifacts that can be highly undesirable from the user's perspective. In addition, these artifacts can be even more distracting when a user of a hearing device listens to streamed audio. Moreover, some reconfigurations may be triggered entirely by the hearing device (e.g., due to battery condition, Bluetooth® protocol, adjustments in audio transmission parameters such as bandwidths and latency, opening and closing of vents, etc.). These artifacts can be especially disturbing to users as they cannot attribute them to any action.

Some traditional hearing devices have accepted specific artifacts in certain use case. Unfortunately, this comes with the drawback of compromising the user experience. Alternatively, some traditional hearing devices have completely stopped an activity before starting another interfering activity—this way working around artifacts that are caused by the activities' coexistence. The drawback of completely stopping an activity before starting another is the limitation to non-parallel activities. Another solution often used by some traditional devices is to modify one or more of the involved activities or configurations statically and in a predetermined manner whenever a certain high-level condition is reached (e.g., when another activity or use case is about to start). This solution can be practicable but can also lead to decreased performance and assumes that trade-offs are acceptable and even possible. Other solutions such as filtering or other dynamic adaption of the audio signals (e.g., muting, mixing, and fading) when changing between different hearing device activities have been used by some traditional devices.

In contrast to these traditional techniques, various embodiments of the present technology reschedule or wait for an optimal situation (e.g., loud period in a signal) in order execute the change in activities in the hearing device that may generate an undesirable artifact. Some embodiments provide for techniques that schedules, reschedule, or trigger hearing device activities at the optimal points in time in order to achieve an artifact-free (or at least artifact hidden) user experience.

Various embodiments can use the measured (e.g., historical) audio signal as well as a predicted (e.g., future) audio signal so that interfering activities from a disrupter (e.g., source of artifacts) can be scheduled or rescheduled dynamically during runtime. As a result, any artifacts can be delayed to a point in time when they are expected to have minimal impact for the user. In other words, the interfering activities can be set to occur at a time so that the resulting artifact is hidden (partially or fully) by masking of any sort, including muting or covering by comfort noise or a system notification beep.

Some embodiments formulate the minimization as an optimization problem with soft and hard constraints regarding the urgency of carrying out an action (e.g., subject to strict deadlines of activities), which can be solved for points in time (or scheduling opportunities) with minimal cost in terms of artifact disturbance for the user. Different degrees of prior information exist that help in determining an optimal schedule. Some artifacts can be characterized and/or are rather well known with respect to their signal shape, duration, or strength. Audio data from the past can be available through the classifier. The sample buffer of the DSP allows for some more informed predictions of scheduling opportunities to trigger the next interfering activity. Predictability also depends on the amount of accepted delay or latency of an audio signal.

Some embodiments can solve (or find an approximate solution to) the optimization problem by analyzing and predicting the hearing device audio signal. For example, in some embodiments, the hearing device may delay an activity that is likely to cause artifacts until heavy ambient noise occurs, or even simpler, until next notification beep is played on the hearing device. In some embodiments, when playing the notification beep, the hearing device can be muted, the activity can be triggered and the reconfiguration action takes place, and then the hearing device can be unmuted again. Generally, the reconfiguration actions are typically rather short and should usually not take more than a few milliseconds (e.g., less than 50 milliseconds). Use cases and changes in parallel activities that can cause aforementioned artifacts include reconfigurations of the hearing device's analog subsystem or wireless subsystem. Some example of reconfigurations can include, but are not limited to the following: 1) Telecoil coexistence with 2.4 GHz; 2) Eavesdropping management while using Advanced Audio Distribution Profile (A2DP), 3) Bluetooth Low Energy (BLE) traffic during audio streaming; 4) Power management; and/or 5) Vent changes. For example, during a Telecoil coexistence with 2.4 GHz, the hearing device can reschedule and trigger activities of wireless protocols (e.g., Bluetooth Classic paging or Bluetooth Low Energy advertising) when they fit the Telecoil audio signal best, resulting in minimal impact on user experiences. Eavesdropping for A2DP can reschedule and trigger activities like setup, binaural acknowledgements and reconnection activities for an eavesdropper which lost its link when they fit best (e.g., with respect to the streamed audio signal to the eavesdropping enabler).

BLE traffic during audio streaming can be rescheduled and trigger activities like data transfer via BLE to fitting stations and apps when they fit best (e.g., with respect to Binaural VoiceStream Technology (BVST), Bluetooth Classic Hands Free Protocol (HFP) or DM audio streams). In some embodiments, additional artifact mitigation may be leveraged by adjusting the proposed performance plan or audio transmission in order to relax the communication flow from client side. This may finally result in more flexibility for rescheduling and triggering the interfering activities. Power management and low-battery state can cause rescheduling and trigger activities like low-battery induced events (e.g., with respect to power supply rejection ratio (PSRR)) when they fit best. Finally, opening or closing of a vent (also referred to as an active vent) could cause an artifact because a vent makes a noise while changing between opened and closed.

In the best case, all undesirable artifacts can be hidden from the user. Most activities can be delayed only for a for a period of time within a scheduling window. For example, the scheduling window may set a certain maximal amount of time (i.e., deadline). Suitable scheduling opportunities generally cannot be guaranteed within the scheduling window. As such, in the worst case, the suggested system and method may arrive at suboptimal solutions. However, in accordance with various embodiments, found solutions will on average be at least as good as the hearing device behavior without the disclosed artifact mitigation techniques.

Some embodiment may include the ability to characterize and generate external audio sources for dynamically creating the masking event. The dynamically created masking events may include muting, comfort noises, replays, and the like. For example, muting of the hearing device may include providing no input signal/power via the audio path. As such, the artifact will not be audible since artifacts on the audio path are not played to the user at all. Other embodiments may include providing comfort noise as masking events. The comfort noise may be extracted noise/audio characteristics from the input signal. These sampled portions may be used to generate a masking event (e.g., noise/audio) artificially for masking the artifact. As another example, some embodiments may replay the buffered audio samples to mask the artifact. In some embodiments, the audio signal can originate from one or more connected remote devices (e.g., binaurally connected contra-lateral hearing device provides its microphone signal to the hearing device for masking the artifact).

Various embodiments of the present technology provide for a wide range of technical effects, advantages, and/or improvements to hearing devices, computing systems and/or related components. For example, various embodiments include one or more of the following technical effects, advantages, and/or improvements: 1) intelligent device reconfiguration of hearing devices; 2) ability to prioritize and schedule complex device reconfigurations to improve user experience; 3) integration of machine learning and artificial intelligence engines to analyze audio signals and user behavior to identify/predict timing of masking events to coordinate rescheduling of disruptive reconfigurations of the hearing device to minimize or reduce artifact presentation (e.g., by masking); 4) ability to shift selected features of the hearing device in time to minimize or reduce artifact presentation or disruption; 5) use of unconventional and non-routine operations to automatically adapt functionality and/or performance of a hearing device while efficiently balancing performance and disruption (e.g., presentation of artifacts) to a user; and/or 6) insertion of a control layer in-between different modules that adds a layer of intelligence to insert a delay or schedule an action that is dependent on the artifact and what the user hears (e.g., behind a notification beep).

In the following description, for the purposes of explanation, numerous specific details are set forth in order to provide a thorough understanding of embodiments of the present technology. It will be apparent, however, to one skilled in the art that embodiments of the present technology may be practiced without some of these specific details. While, for convenience, embodiments of the present technology are described with reference to artifact mitigation within hearing devices, embodiments of the present technology are equally applicable to various other devices which produce artifacts by changing operating characteristics that result in degraded user experiences.

The techniques introduced here can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to program a computer (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions.

The phrases "in some embodiments," "according to some embodiments," "in the embodiments shown," "in other embodiments," and the like generally mean the particular feature, structure, or characteristic following the phrase is included in at least one implementation of the present technology, and may be included in more than one implementation. In addition, such phrases do not necessarily refer to the same embodiments or different embodiments.

FIG. 1 illustrates an example of an environment 100 in which some embodiments of the present technology may be utilized. As illustrated in FIG. 1, environment 100 may include a user 110 using hearing device 120 to magnify sounds or signals generated by external sources 130A-130N (e.g., a mobile phone, tablet computer, mobile media device, mobile gaming device, vehicle-based computer, wearable computing device, individual, television, sound system, car, etc.). In some cases, hearing device 120 can be communicably connected to external sources 130A-130N via a communications link (e.g., Bluetooth®). In some embodiments, the audio signal can originate from one or more connected remote devices (e.g., binaurally connected contra-lateral hearing device provides its microphone signal to the hearing device for masking the artifact). As described in more detail below hearing device 120 can include various sensors and input/output components.

Hearing device 120 can be configured to automatically (e.g., without human intervention) adapt one or more operating characteristics (e.g., functional adaptations, performance adaptations, physical adaptations, etc.) to meet performance objectives. These reconfigurations of the operating state of hearing device 120 can result in spurious sound events called artifacts to be produced by hearing device 120. For example, the reconfigurations of some operating characteristics (or operating states) may cause a pop, whistle, hum, change in volume level, whine, or other undesired sound effect to be perceivable by user 110. Artifacts may be triggered by user actions that result in reconfigurations or via automatic activities of hearing device 120. For example, a user may specifically request a feature of hearing device 120 be activated or deactivated and the resulting reconfiguration may cause an artifact to be generated.

In accordance with various embodiments, hearing device 120 can include an artifact mitigation system or protocol 140 that can reduce or eliminate many undesired artifacts. As illustrated in FIG. 1, the hearing device can monitor during monitoring operation 150 for state changes which may be the result of requests from user 110 or from automatic hardware or software reconfigurations. These hardware and/or software reconfigurations may be currently happening or may be in the future (e.g., the next few seconds, minutes, or even another day as with software updates). Some of the reconfigurations to the operating characteristics may be urgent while others may be able to be delayed for a period of time. Identification operation 160 can identify a window in which the reconfiguration needs to be executed. For example, this may be based on a reconfiguration priority in some embodiments.

Event identification operation 170 can determine if there is any time during the window that the artifact produced by the reconfiguration can be masked (completely or partially) by various events (e.g., in the audio signal, a system beep, a system notification, etc.). For example, in some embodiments, event identification operation 170 can analyze a buffered audio signal (e.g., unprocessed signal from external source 130A-130N) that has not been presented to the user by hearing device 120 to identify audio signal characteristics that could mask the artifact (e.g., increases in background noises). If a masking event is identified the state change (or reconfiguration) can be scheduled during scheduling operation 180. If no masking event is identified, then the state change can be executed at the end of the window identified by identification operation 160. As a result, hearing device 120 can wait to apply changes when it is a good time (e.g., there is a lot of external audio noise transduced by the microphone).

When a reconfiguration or change in operating characteristics will produce an artifact, and the nature of the artifact produced, will depend on the specific hardware, software, and firmware configuration of hearing device 120. For example, a firmware update may produce an artifact during set of reconfigurations that previously did not produce an artifact. Often, manufacturers of hearing devices analyze the impact of the designs on the production of artifacts and identify which changes (e.g., from configuration 1 to configuration 2) will produce an artifact. This information can be included within the firmware or software to allow artifact mitigation system or protocol 140 to schedule to the reconfirmation to minimize the artifact effect on the user experience. The following table illustrates an example of

| State 1 | State 2 | Artifact |
|---|---|---|
| Vent open | Vent closed | Yes |
| Binaural communication lost link | Binaural communication reconnection | Yes |
| Codec 1 | Codec 2 | Yes |
| Codec 1 | Codec 3 | No |
| Bluetooth ® streaming | Bluetooth Streaming and data transfer | Yes |
| Full batter power state | Low battery power state | Yes |
| A2DP eavesdropping stopped | A2DP eavesdropping re-started/re-synchronized | Yes |

Some embodiments may submit recorded audio signals and system states to a cloud-based analysis platform that can automatically analyze the user's experience (e.g., using machine learning/artificial intelligence engines). The results from the analysis can be used to create updates to the system design (e.g., firmware) or control logic for improving the artifact mitigation system used in some embodiments.

Figure 2:
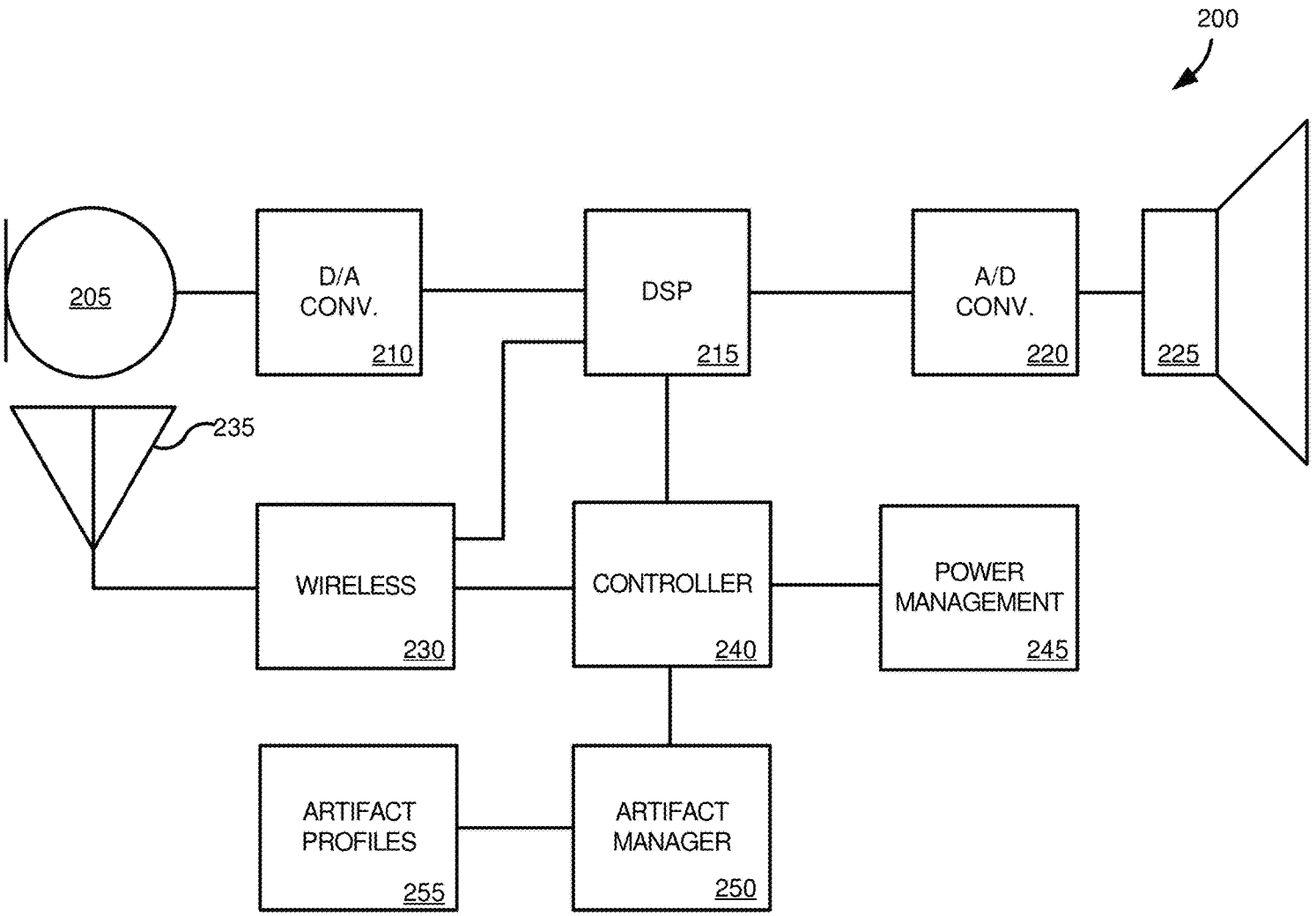
FIG. 2 illustrates a set of components within a hearing device according to one or more embodiments of the present technology.

FIG. 2 illustrates a set of components within a hearing device 200 according to one or more embodiments of the present technology. As shown in FIG. 2, hearing device 200 may include microphone 205, digital to analog converter 210, digital signal processor 215, analog to digital converter 220, speaker 225, wireless module 230, antenna 235, controller 240, power management module 245, artifact manager 250, and artifact profiler 255. While not illustrated in FIG. 2, various embodiments of hearing device 200 may include additional components such as batteries (e.g., rechargeable batteries), data storage components (e.g., flash memory, volatile and/or non-volatile memories, etc.), sensors (e.g., biological sensors such as accelerometers or heart rate monitors), coprocessors, a baseband processor (e.g., to perform additional signal processing and implement/manage real-time radio transmission operations), and the like may be present.

Other embodiments may include varying combinations of electronical and mechanical components (e.g., vents). Microphone 205 can pick up the surrounding sound and translate that sound into an electrical signal which can be digitized (e.g., sampled and quantized) using digital to analog converter 210. Digital signal processor 215 can process (e.g., to take into account the hearing impairment of the user of the hearing device) the digitized signal. A digital to analog converter 210 can convert the output signal from the digital signal processor 215 into an output signal, and speaker 225 (e.g., acting as an electroacoustic transducer) can then produce a sound signal that can be projected into an ear canal of the user. Some hearing devices may have different configurations and features. For example, a cochlea implant may have a set of electrodes to deliver electrical impulses directly to the hearing nerve instead of a transducer.

Digital signal processor 215 can be communicably coupled to wireless module 230 which can use antenna 235 to transmit and receive wireless signal outside of hearing device 200. For example, in some embodiments wireless module 230 may provide communication using ZigBee, Bluetooth®, Bluetooth® Low Energy (BTLE), Ultra-wideband, or other personal area network communication technologies. In some embodiments, wireless module 230 may directly provide networking connections directly to cellular networks (e.g., 5G networks).

Controller 240 can be configured among other tasks to control device reconfigurations (e.g., modification of one or more operational characteristics) of hearing device 200 based on input from power management module 245 and/or artifact manager 250. The operational characteristics can include performance adaptations and/or functionality adaptations. The performance adaptation can include, for example, a reduction in an amount of sound amplification, reduction or shift in bandwidth of an amplified signal, a change in a codec type, or reduction of frequency of monitoring sensors. The functionality adaptation can include, for example, a reduction in wireless functionality, a reduction in supported wireless protocols, reduction in monitoring for the presence of an inductive loop. Power management module 245 can be configured to set operational characteristics based on detection of various triggers. For example, when the battery level reaches a certain level (e.g., ten percent), power management module can implement preconfigured power profiles.

Artifact manager 250 can be dynamically used by controller 240 to schedule the specific timing of the reconfigurations (or other activities) of hearing device 200. In some embodiments, artifact manager 250 can monitor various system states (e.g., buffered audio signals within DSP 215, remaining battery capacity, etc.), user activity (e.g., mode change requests, predicted activity, etc.), user preferences, and/or other factors to determine if a change will produce an artifact and, if so, a timing of that reconfiguration to improve the user experience (e.g., by masking or mitigating the artifact). In some embodiments, artifact profiler 255 can use artificial intelligence or machine learning to learn identify and classify artifacts produced by system reconfigurations (e.g., changes to one or more operating characteristics).

Figure 3:
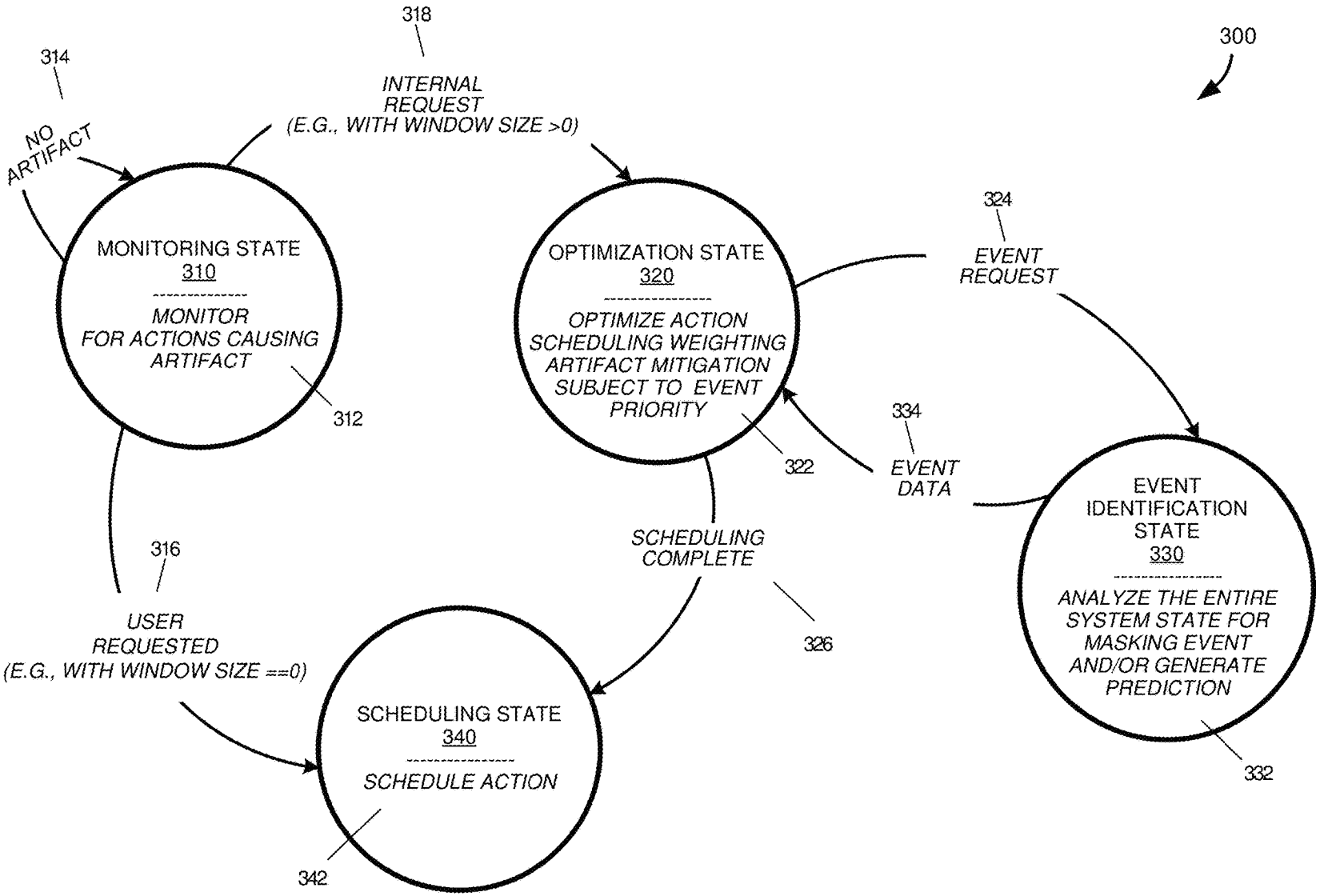
FIG. 3 illustrates a state flow diagram illustrating a set of states of a hearing device according to various embodiments of the present technology.

FIG. 3 illustrates a state flow diagram 300 illustrating a set of states of a hearing device according to various embodiments of the present technology. As shown in the embodiments illustrated in FIG. 3, the state flow diagram 300 can includes states 310, 320, 330, and 340, entry actions 312, 322, 332, and 342, and transition conditions 314, 316, 318, 324, 326, and 334. The state operations and transitions shown in state flow diagram 300 may be performed in various embodiments by a hearing device such as, for example, hearing device 120 of FIG. 1, or one or more controllers, modules, engines, processors, or components associated therewith. Other embodiments may include additional or fewer states, entry actions, and/or transition conditions than those illustrated in the embodiments shown in FIG. 3. For example, various maximum time reached transition conditions may exist in some embodiments.

A hearing device can be placed into monitoring state 310 to perform entry action 312 which monitors for actions causing artifacts that have a negative impact on a user experience. As illustrated in FIG. 3, requests for reconfigurations of operating characteristics (e.g., from user, internal components, external sources, etc.) may be analyzed to determine whether an artifact will be produced. When no artifact will be produced, transition condition 314 allows the hearing device to remain in monitoring state 310. When a user reconfiguration is requested (e.g., transition condition 316 illustrated in FIG. 3), the hearing device can transition from monitoring state to scheduling state 340 where entry action 342 may have to schedule the reconfiguration with high priority. For example, upon user request, the action may need to be scheduled immediately (e.g., the scheduling window is actually zero), but can also follow path 318, etc., like internal component requests, if there is more time (e.g., the scheduling window large enough). This depends on the user action. Otherwise, or when an internal component requests a reconfiguration that will cause an artifact, from monitoring state 310 transition condition 318 is activated, and the hearing device transitions from monitoring state 310 to optimization state 320.

Upon entry to optimization state 320, the hearing device performs entry action 322 where action scheduling (or rescheduling if a timing is proposed) is computed to reduce or minimize the negative impact of the artifact on the user experience. For example, in some embodiments, this can be done by weighting artifact mitigation subject to event reconfiguration priority, timing constraints, and/or other restrictions or preferences. In order to generate an optimal (or approximately optimal) schedule, optimization state 320 can generate transition condition 324 by requesting a masking event identification. This results in the hearing device transitioning from optimization state 320 to event identification state 330 where entry action 332 analyzes the entire system state for masking events and/or to generate a prediction. For example, in some embodiments, entry action 332 may include analyzing an audio buffer for masking events or generating a prediction, for example from the audio buffer, of likely timing of masking events (e.g., system beeps or notifications, environmental sound variations, etc.). As another example, entry action 332 may cause a DSP with algorithm parameters, like output from classifier, to identify the optimal instance. As such, some embodiments may not rely on the available samples in the audio buffer (e.g., at all or entirely) but may take into consideration the history of external audio.

Once a masking event is identified, transition condition 334 is used to transition back to optimization state 320 where the scheduling optimization is completed. Optimization state 320 can generate a flag indicating completion resulting in triggering transition condition 326 causing the hearing device to move from optimization state 320 to scheduling state 340 where entry action 342 schedules the reconfiguration at the time identified by optimization state 320 to minimize (or reduce) the reconfiguration.

Figure 4A:
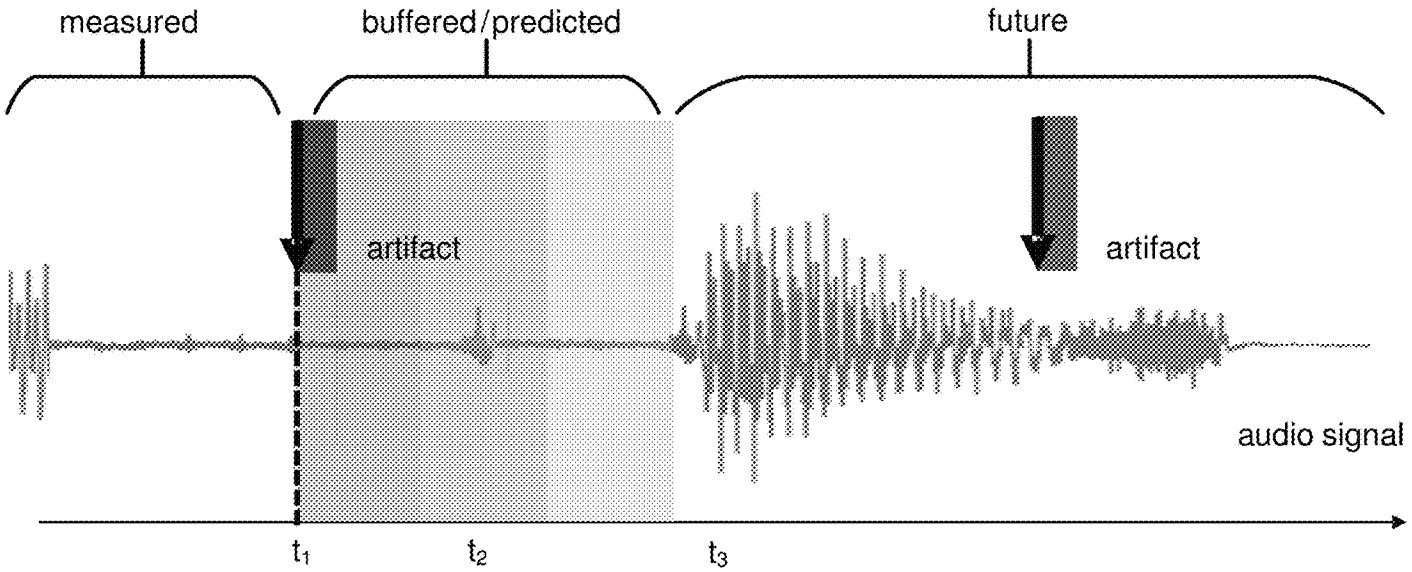
FIGS. 4A-4B illustrates an audio signal that may be analyzed to identify rescheduling of a disrupting event in order to mask a resulting artifact within the audio signal according to one or more embodiments of the present technology.
Figure 4B:
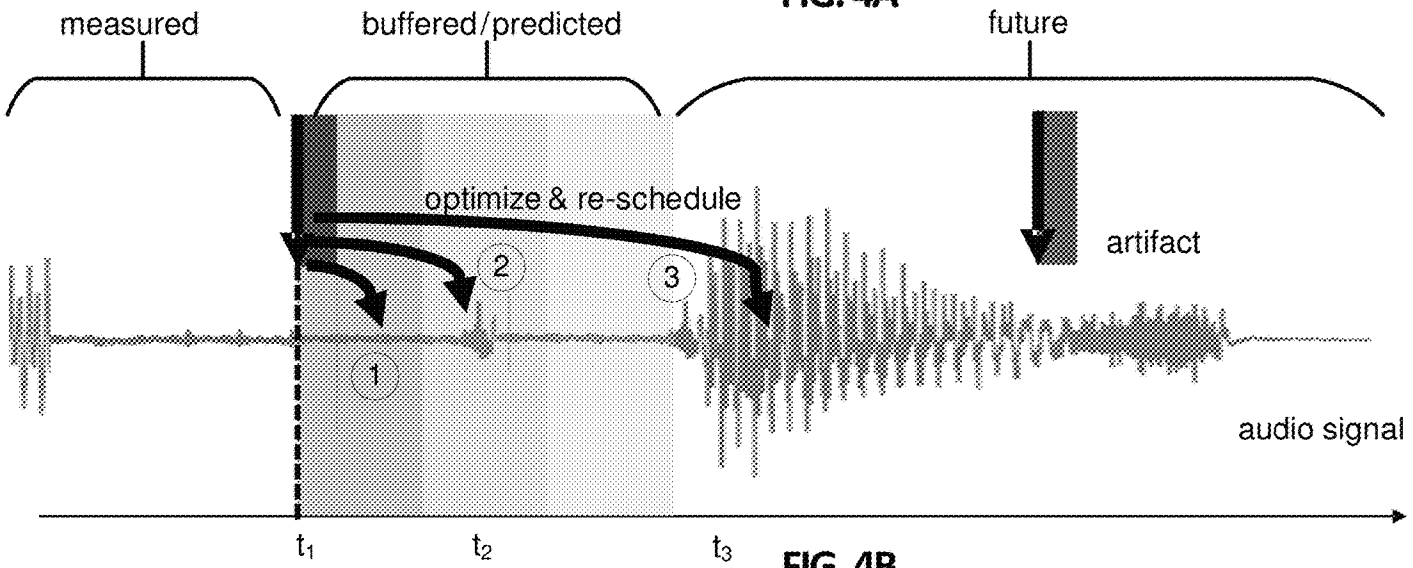

FIGS. 4A-4B illustrates an audio signal that may be analyzed to identify rescheduling of a disrupting event (e.g., a reconfiguration) in order to mask a resulting artifact within the audio signal according to one or more embodiments of the present technology. Different scenarios exist for artifact creation. For example, artifacts may be introduced at the MADC due to voltage supply ripples which propagate through the system and might be filtered out as opposed to artefact introduced at the other end of the system (e.g. vent control that introduces a 'plop' noise without signal path contribution). Depending on where the artifact is introduced in the system, the measures and strategies for scheduling may differ (e.g., for the active vent plop the last resort is to wait for a noisy environment to do it while an artifact introduced from the MADC may be scheduled such that it can be replaced neatly within the hearing aid by an appropriate audio snipped in view of the identified external audio signal or audiological situation).

As illustrated in FIG. 4A, an audio signal is being received and processed by a hearing device. The illustrated audio signal is the input signal as a microphone of the hearing device would perceive the audio signal (prior to any signal processing applied by the hearing device). The hearing device processes the signal to enhance the listening experience of the user and produces the measured portion of the signal. At a certain time ($t_1$), a device reconfiguration of one or more operating characteristics is detected that will produce an artifact. Some embodiments may present a proposed reconfiguration time. The vertical arrows represent the points in time when an artifact would appear if the reconfiguration is not re-scheduled.

Instead of just allowing the artifact to be produced at this time, some embodiments analyze the buffered signal (e.g., which may occur during vent control described earlier) in order to identify whether events exist within the audio signal can be used to mask the artifact. In some embodiments, a prediction about the future signal may be made in order to identify whether events exist within the audio signal can be used to mask the artifact. The predictions may be useful in the MADC example described above.

Figure 5:
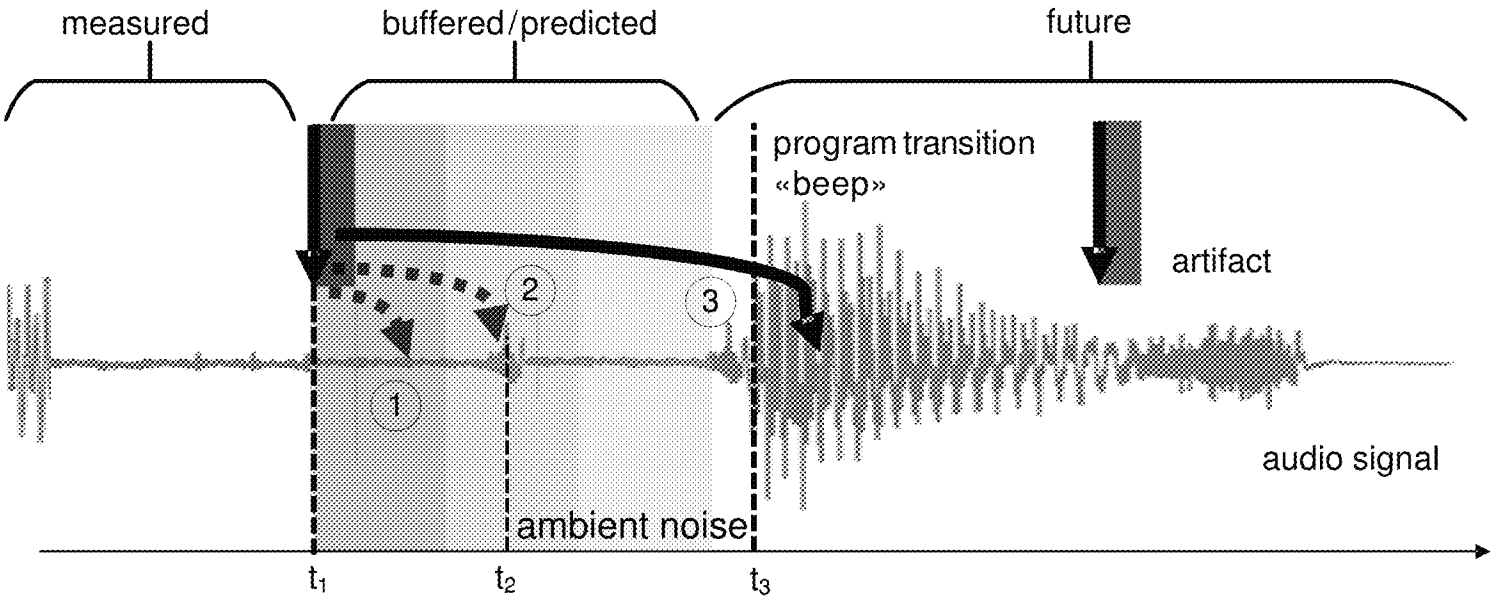
FIG. 5 illustrates identification of ambient noise and program transition notifications that may be used to mask an artifact according to various embodiments of the present technology.
Figure 6:
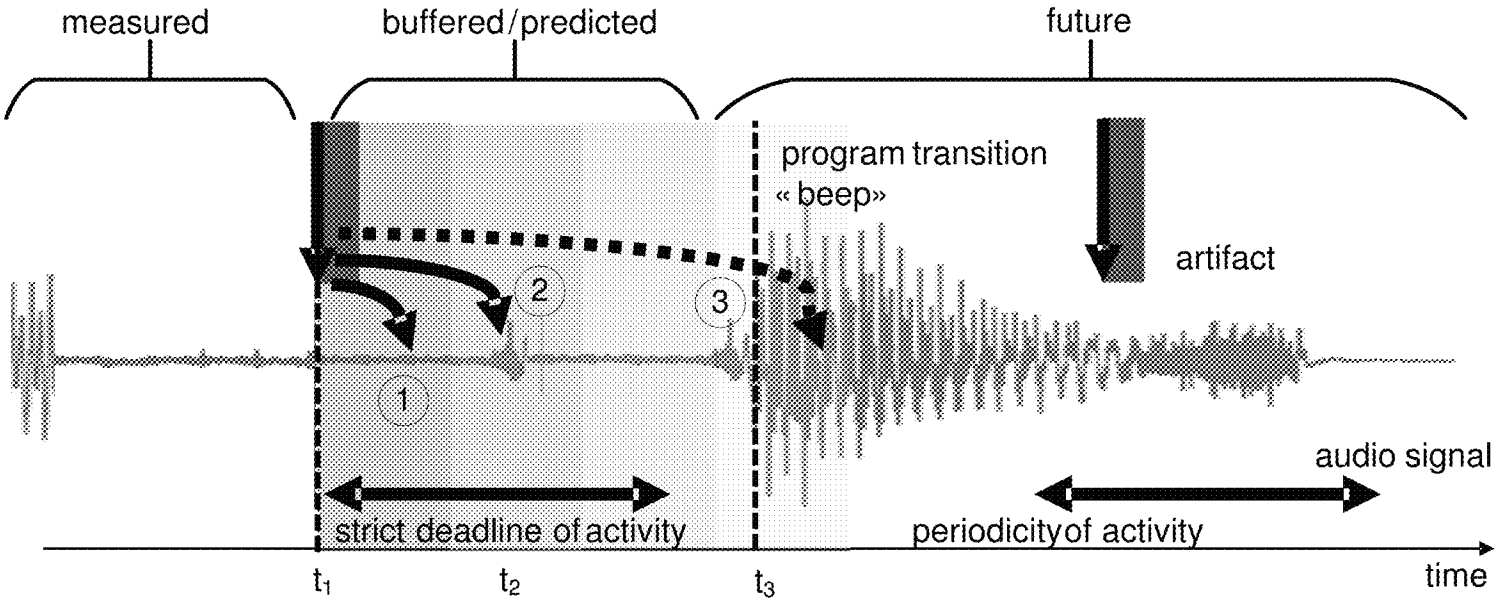
FIG. 6 illustrates restrictions on timing of disrupting events that may be used in rescheduling disrupting events that may be used to mask an artifact according to some embodiments of the present technology.

As illustrated in FIG. 4B, the reconfiguration may be moved to sites 1, 2, or 3. The signal is shown in the time-domain (i.e., high amplitudes represent loud input signals) and loud input signals (e.g., ambient noise) can be used to "hide"/mask audible artifacts produced by the reconfiguration. The arrows from the artifact timing arrow to the audio sites 1, 2, or 3 symbolize possible choices for rescheduling the artifacts (e.g., they represent the act of optimization through an intelligent control unit). The dashed arrows (illustrated in FIGS. 5 and 6) indicate that particular choices ruled out in the optimization process. For this, there can be different reasons. For example, because a particular choice is judged as suboptimal given an objective function or performance measure of a specific objective function. Different examples of solutions to the re-scheduling problem are shown in FIGS. 5 and 6). As another example, a hard constraint may eliminate a choice. For example, a strict deadline of an artifact-prone activity, as illustrated in FIG. 6.

FIG. 5 illustrates identification of ambient noise at time ($t_2$) and program transition notifications at time ($t_3$) that may be used to mask an artifact according to various embodiments of the present technology. Which site within the audio signal is most desired (e.g., best or optimal) may depend on the type of artifact, constraints on reconfiguration timing (e.g., must be completed within a specific time such as 500 ms, 5 s, or two hours), priority, interdependence on other reconfigurations, user expectations, the type of masking events identified, and the like. If the reconfiguration can wait until the program transition notification (e.g., a beep) at time ($t_3$), then the hearing device can schedule the reconfiguration so that the artifact is presented during that portion of the audio signal. FIG. 6 illustrates restrictions on timing of disrupting events that may be used in rescheduling disrupting events that may be used to mask an artifact according to some embodiments of the present technology. As such, if there is a strict deadline of activity that the third option does not fall within, then the first or second site will need to be selected.

While FIGS. 4-6 illustrate embodiments of the artifact mitigation techniques that may be done based on a time domain analysis, other embodiments may use other techniques. For example, may "hide" artifacts based on an analysis of i) the frequency-domain instead, in order to find time segments where the frequencies of the artifact are least noticeable given the frequencies of the input signal, and/or ii) taking context information into account. Examples for such context information are: re-scheduling an artifact for "hiding" it behind a program transition beep (e.g., as illustrated in FIG. 5). Some embodiments may include a certainty ranking or profile representing the likelihood that the program transition will be at a certain point in time, of a certain duration, of a certain shape of beep signal, having a certain frequency profile, etc. In some embodiments, the hearing device can control such events by itself, which makes them deterministic compared to the much more uncertain future input audio signals. Another example for context information is that an artifact does not become audible when, e.g., music is played but only when outside the music program, respectively when the input audio signal contains a higher proportion of less clear, more noisy sounds.

Figure 7:
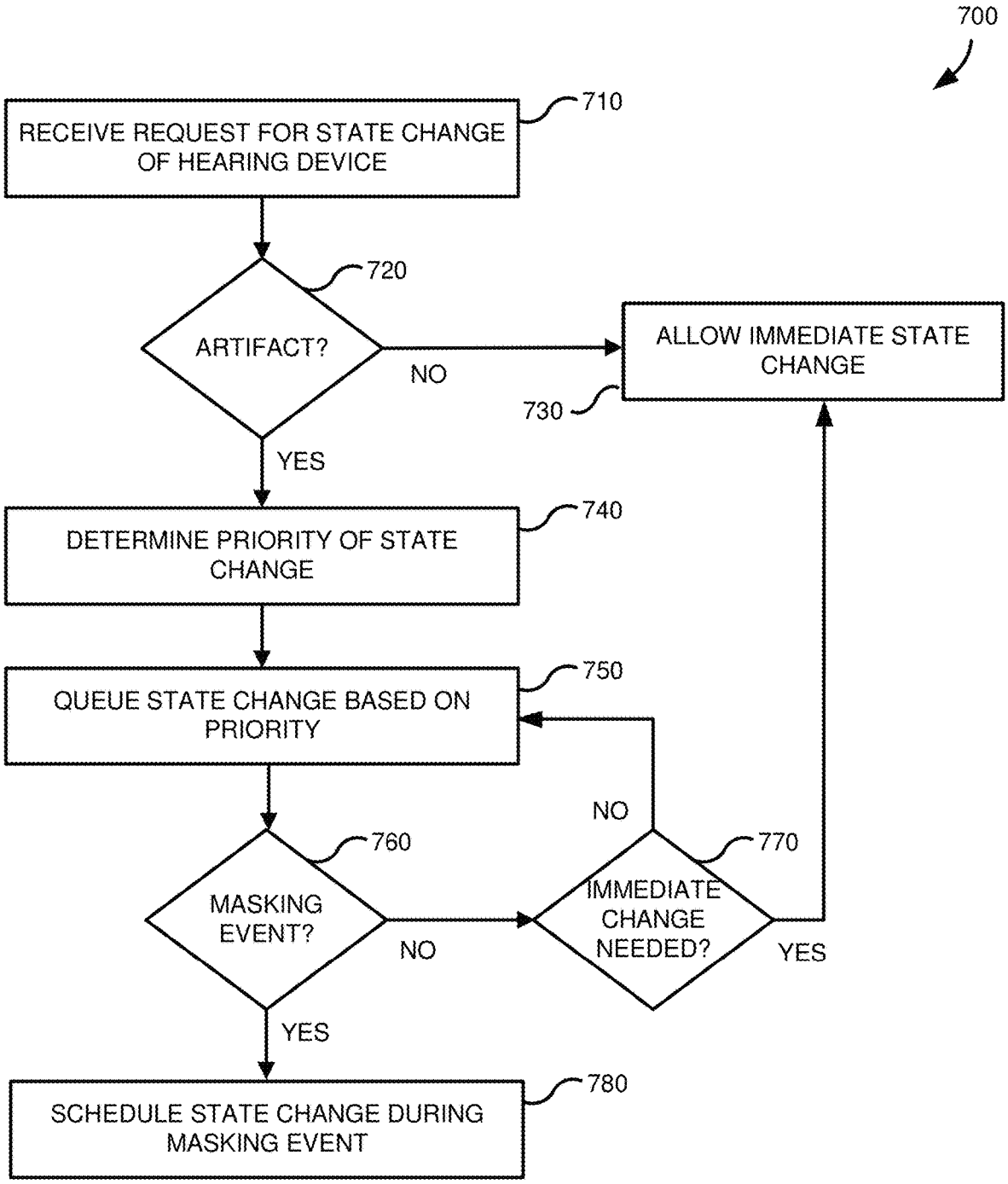
FIG. 7 is a flowchart illustrating a set of operations for dynamically scheduling disrupting device reconfigurations in accordance with one or more embodiments of the present technology.

FIG. 7 is a flowchart illustrating a set of operations 700 for dynamically scheduling disrupting device reconfigurations in accordance with one or more embodiments of the present technology. The operations illustrated in FIG. 7 may be performed by a hearing device, a processor, a controller, an artifact manager, a supervisory module, a DSP, and/or other component. As illustrated in FIG. 7, receiving operation 710 can receive a request for a state change or reconfiguration of one or more operational characteristics of the hearing device. The request can originate from the user or from an internal component.

Determination operation 720 can determine whether the state change will produce an artifact. When determination operation 720 determines that no artifact will be produced, determination operation 720 can branch to change operation 730 where an immediate state change can be authorized or implemented. When determination operation 720 determines that an artifact will be produced, determination operation 720 can branch to priority operation 740 where a priority of the state change can be determined. For example, in some embodiments the requesting component may indicate a priority level (e.g., low, medium, high, critical, etc.) of the state change or indicate a time period (e.g., 500 ms, 1 minute, 3 hours, etc.) in which the state change must be performed.

Queuing operation 750 can queue state change based on the priority level. While masking operation 760 attempts to identify a masking event. This may be done by analyzing a buffered audio signal. In some embodiments various classifiers (e.g., artificial neural networks, support vector machines, and/or the like) may be used. In some embodiments, knowledge of the system state and future scheduling (e.g., of system notifications or beeps) of injected audio presentations may be used by masking operation 760. When masking operation 760 determines that there are no masking events on the horizon (e.g., within the audio buffer or prediction window), then masking operation 760 branches to urgency determination operation 770 which analyzes the pending request for reconfiguration to determine whether an immediate change is needed.

For any requests within the queue that are identified by urgency determination operation 770 as needing an immediate change, those requests are removed from the queue and executed using change operation 730. In some embodiments, the hearing device may inject selected masking events (e.g., specific beeps, mutes, etc.) when artifact producing changes need to be immediately scheduled. As such, the produced artifact can be hidden even though the masking event would not occur within the scheduling window. Some embodiments may provide a graphical user interface that allows a user to experience certain artifacts and select desired masking events (e.g., beeps, muting, etc.) to hide those artifacts.

Any requests within the queue that are identified as not needing immediate execution by urgency determination operation 770 are left in the queue. When masking operation 760 determines that there are no masking events on the horizon (e.g., within the audio buffer or prediction window), then masking operation branches to scheduling operation 780 where the timing of the reconfiguration of the hearing device is timed so that the artifact that will be produced will occur at a time corresponding to the masking event identified by masking operation 760. Scheduling operation 780 may also determine whether the hearing device has any ability to change the timing of the masking event. When the hearing device has the ability to adjust the timing of the masking event, scheduling operation may move the masking event (and/or artifact) in time so that the masking event and artifact overlap to create an improved experience for the user. In some embodiments, masking operations may search for all state changes in the queue.

Figure 8:
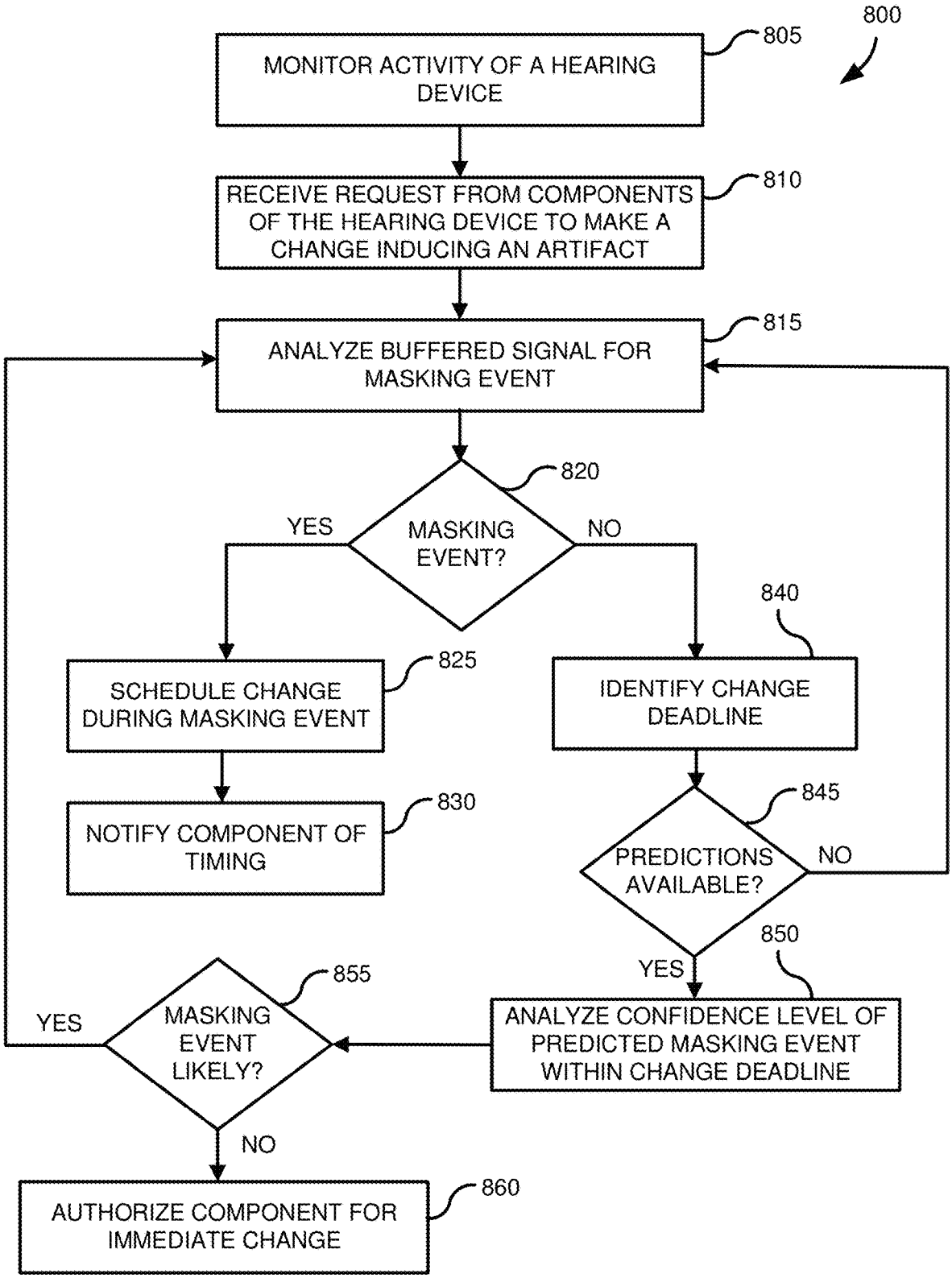
FIG. 8 is a flowchart illustrating a set of operations for operating a hearing device in accordance with some embodiments of the present technology.

FIG. 8 is a flowchart illustrating a set of operations 800 for operating a hearing device in accordance with some embodiments of the present technology. The operations illustrated in FIG. 8 may be performed by a hearing device, a processor, a controller, an artifact manager, a supervisory module, a DSP, and/or other component. As illustrated in FIG. 8, monitoring operation 805 monitors activity and operational characteristics of a hearing device. In accordance with some embodiments, various components may be required to submit requests to a controller or supervisory module to make changes to the operational characteristics or state of the hearing device. During receiving operation 810, these requests can be received and analysis operation 815 can analyze the buffered signal for one or more masking events. The masking events may include, for example, a muting of the audio signal, external noise, a replay of a buffered audio sample, or the like.

For example, the components can request the change can include, but are not limited to, a mixed signal ASIC, a DSP, a microcontroller, an analog part (e.g., ADC and DC-DC converter, microphone, etc.) that may need to switch states.

Event detection operation 820 can determine whether a masking event has been identified. The masking event may need to have various characteristics (e.g., within a particular time window, of a particular magnitude, have a general frequency profile, or the like) in order to be identified by event detection operation 820 as a masking event for the particular artifact that will be induced by the reconfiguration. When event detection operation 820 identifies a suitable masking event, then event detection operation 820 branches to scheduling operation 825 where the time of the schedule change is identified. Notification operation 830 can then notify the requesting component of the timing for inducing the device reconfigurations (e.g., change in operational characteristics, functional characteristics, physical configurations, etc.). When event detection operation 820 fails to identify a suitable masking event, then event detection operation 820 branches to timeline identification operation 840 where a deadline for implementing the change is identified.

Some embodiments may have a prediction capability based on audio patterns, system notifications, or the like. When prediction determination operation 845 determines that no predictions are available, then prediction determination operation 845 branches to analysis operation 815 where the audio signal is reanalyzed as the buffer changes. When prediction determination operation 845 determines that predictions are available, then predication operation 845 branches to confidence operation 850 where a confidence level of the prediction is analyzed (or generated if one is not provided) that the masking event will occur within any needed deadline. Determination operation 855 determines (e.g., based at least in part on the confidence level) whether the masking event is likely. If no masking event is likely, then determination operation 855 branches to change operation 860 where the component is authorized to request an immediate change. In some situations, the masking event or prediction predicts total silence of the input signal in case of an artifact generated at the input of the signal path. As such, one solution is to mute the output during state change as the user will not notice this. When determination operation 855 determines that the masking event is likely before the deadline, then determination operation 855 branches to analysis operation 815 where the audio signal is reanalyzed as the buffer changes.

Conclusion

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the technology is not intended to be exhaustive or to limit the technology to the precise form disclosed above. While specific examples for the technology are described above for illustrative purposes, various equivalent modifications are possible within the scope of the technology, as those skilled in the relevant art will recognize. For example, while processes or blocks are presented in a given order, alternative implementations may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

The teachings of the technology provided herein can be applied to other systems, not necessarily the system described above. The elements and acts of the various examples described above can be combined to provide further implementations of the technology. Some alternative implementations of the technology may include not only additional elements to those implementations noted above, but also may include fewer elements.

These and other changes can be made to the technology in light of the above Detailed Description. While the above description describes certain examples of the technology, and describes the best mode contemplated, no matter how detailed the above appears in text, the technology can be practiced in many ways. Details of the system may vary considerably in its specific implementation, while still being encompassed by the technology disclosed herein. As noted above, particular terminology used when describing certain features or aspects of the technology should not be taken to imply that the terminology is being redefined herein to be restricted to any specific characteristics, features, or aspects of the technology with which that terminology is associated. In general, the terms used in the following claims should not be construed to limit the technology to the specific examples disclosed in the specification, unless the above Detailed Description section explicitly defines such terms. Accordingly, the actual scope of the technology encompasses not only the disclosed examples, but also all equivalent ways of practicing or implementing the technology under the claims.

To reduce the number of claims, certain aspects of the technology are presented below in certain claim forms, but the applicant contemplates the various aspects of the technology in any number of claim forms. For example, while only one aspect of the technology is recited as a computer-readable medium claim, other aspects may likewise be embodied as a computer-readable medium claim, or in other forms, such as being embodied in a means-plus-function claim. Any claims intended to be treated under 35 U.S.C. § 112(f) will begin with the words "means for", but use of the term "for" in any other context is not intended to invoke treatment under 35 U.S.C. § 112(f). Accordingly, the applicant reserves the right to pursue additional claims after filing this application to pursue such additional claim forms, in either this application or in a continuing application.

What is claimed is:

1. A method for reducing an impact of artifacts on a user experience, the method comprising:

detecting a reconfiguration of operating characteristics of a hearing device that will produce an artifact, wherein the reconfiguration of operating characteristics of the hearing device is currently in progress or predicted to occur at a later time;

identifying a masking event to that can disguise the artifact produced by the reconfiguration of operating characteristics of the hearing device, wherein identifying the masking event includes analyzing a buffer of an audio signal received by a microphone of the hearing device to detect audio characteristics of the audio signal to hide the artifact; and scheduling the reconfiguration of operating characteristics of the hearing device or scheduling the masking event so that the artifact is produced during the masking event.

2. The method of claim 1, further comprising making a prediction that the masking event will not occur within a scheduling window and scheduling the reconfiguration of operating characteristics of the hearing device within the scheduling window without the masking event.

3. The method of claim 1, further comprising:

making a prediction that the masking event will not occur within a scheduling window; and scheduling the reconfiguration of operating characteristics of the hearing device within the scheduling window with an artificially generated masking event.

4. The method of claim 1, further comprising:

identifying a profile of the artifact that is to be produced by the reconfiguration of operating characteristics of the hearing device; and wherein identifying the masking event is based, at least in part, on the audio characteristics of the audio signal that will hide the artifact.

5. The method of claim 4, wherein the profile of the artifact includes a frequency analysis and wherein identifying the masking event includes performing a frequency analysis of the audio signal to identify the masking event that minimizes differences between the profile of the artifact and a corresponding portion of the audio signal.

6. The method of claim 4, wherein identifying the masking event includes selecting the masking event that minimizes differences between the profile of the artifact and a corresponding portion of the audio signal.

7. The method of claim 1, wherein the hearing device is a binaurally-connected contra-lateral hearing device and the method further comprises making use of information from the binaurally-connected contra-lateral hearing device, or one or several other connected remote devices.

8. The method of claim 1, wherein the masking event is an audio event from an audio signal received from a source external to the hearing device, a system notification, or a locally generated audio signal that resembles a current audio signal received from the source external to the hearing device.

9. The method of claim 8, wherein the locally generated audio signal is a replay of a buffered audio sample to mask the artifact.

10. The method of claim 1, wherein the reconfiguration of operating characteristics of the hearing device include a software reconfiguration or a hardware reconfiguration.

11. The method of claim 1, further comprising associating a window in which the reconfiguration of operating characteristics of the hearing device must be completed and wherein identifying the masking event is limited to masking events within the window.

12. The method of claim 1, wherein the masking event includes an amplification in the audio signal, a system notification, or desired frequency components.

13. The method of claim 1, further comprising:

generating a prediction that future masking events will occur within a time frame; and delaying, during the time frame, scheduling of the reconfiguration of operating characteristics of the hearing device until a masking event is detected.

14. A hearing device with an artifact mitigation system to improve a user experience of the hearing device, the hearing device comprising:

a processor;

a battery;

a controller to receive requests requesting to schedule a reconfiguration of operating characteristics of the hearing device; and an artifact manager communicably coupled to the controller to— determine a current state of the hearing device and whether the reconfiguration of the operating characteristics of the hearing device is predicted to produce an artifact;

identify, upon a determination being made that the reconfiguration of the operating characteristics of the hearing device is predicted to produce the artifact, a masking event that can disguise the artifact produced by the reconfiguration of the operating characteristics of the hearing device; and schedule the reconfiguration of the operating characteristics of the hearing device so that the artifact is produced during the masking event by responding to requests.

15. The hearing device of claim 14, further comprising:

a microphone; and a buffer to store an audio signal received by the microphone, and wherein the artifact manager is configured to identify the masking event by analyzing the audio signal stored in the buffer to detect audio characteristics during a portion of the audio signal to attenuate an impact of the artifact on the user experience.

16. The hearing device of claim 14, wherein the artifact manager identifies an optimal masking event by using an optimization solver to evaluate an audio signal subject to one or more constraints.

17. The hearing device of claim 14, wherein the masking event is an audio event from an audio signal received from a source external to the hearing device or a system notification.

18. The hearing device of claim 14, wherein the artifact manager generates a frequency profile of the artifact and identifies the masking event by minimizing a difference between the frequency profile the artifact and a frequency profile of an audio signal.

19. The hearing device of claim 14, wherein further comprising an artificial intelligence engine to automatically identify masking events.

20. A method for mitigating artifacts produced by a hearing device, the method comprising:

monitoring activity of a hearing device to detect an initial scheduling of a reconfiguration of one or more operating characteristics of the hearing device;

determining whether the reconfiguration of the one or more operating characteristics of the hearing device will result in an artifact;

identifying a masking event that can disguise the artifact produced by the reconfiguration of the one or more operating characteristics of the hearing device; and rescheduling the reconfiguration of the one or more operating characteristics of the hearing device so that the artifact is produced during the masking event.

21. The method of claim 20, wherein the masking event includes an amplification in an audio signal, muting, replay, a system notification, or desired frequency components.

22. The method of claim 20, wherein the reconfiguration of the one or more operating characteristics of the hearing device includes a scheduling window.

23. The method of claim 22, wherein the masking event is an optimal masking event selected from multiple masking events using an optimization solver or an artificial intelligence engine.

24. The method of claim 22, wherein the masking event is one of multiple masking events and identifying the masking event from the multiple masking events includes eliminating any of the multiple masking events outside of the scheduling window.

25. The method of claim 22, further comprising muting the hearing device during the reconfiguration of the one or more operating characteristics of the hearing device.

26. The method of claim 20, wherein identifying the masking event includes determining a frequency profile of the artifact and minimizing a difference between the frequency profile of the artifact and a frequency profile of the artifact.

* * * * *